US006442795B1

(12) United States Patent
Chen

(10) Patent No.: US 6,442,795 B1
(45) Date of Patent: Sep. 3, 2002

(54) DAMPER FOR A PIVOT DOOR

(75) Inventor: Teh-Tien Chen, Kaohsiung (TW)

(73) Assignee: Girefa Enterprise Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 09/761,521

(22) Filed: Jan. 16, 2001

(51) Int. Cl.[7] ..... E05F 3/10

(52) U.S. Cl. ..... 16/53; 16/49; 16/52; 16/60; 16/DIG. 9; 16/DIG. 21

(58) Field of Search ..... 16/53, 51, 52, 16/60, 62, 66, 58, 79, DIG. 9, DIG. 10, DIG. 17, DIG. 21, 49

(56) References Cited

U.S. PATENT DOCUMENTS 3,675,270 A * 7/1972 Jentsch ..... 16/53
3,696,462 A * 10/1972 Martin ..... 16/49
3,701,180 A * 10/1972 Jentsch et al. ..... 16/52
4,064,589 A * 12/1977 Bejarano et al. ..... 16/53
4,349,939 A * 9/1982 Tillmann ..... 16/53
4,785,493 A * 11/1988 Tillmann et al. ..... 16/53
5,829,097 A * 11/1998 Toledo ..... 16/53

* cited by examiner

*Primary Examiner*—Chuck Y. Mah
(74) *Attorney, Agent, or Firm*—Rider, Bennett, Egan and Arundel LLP; Alan D. Kamrath

(57) ABSTRACT

A damper for a pivot door has a piston movably received inside the damper and having a first channel and a second channel respectively and selectively communicating with a space full of hydraulic oil, such that the movement of the piston is able to be slowed by the interchange of the communication of the first channel and the space and the second channel and the space. Thus, the movement of the pivot door is slowed.

6 Claims, 6 Drawing Sheets

DAMPER FOR A PIVOT DOOR

BACKGROUND OF THE INVENTION

1. Field of the Invention

The present invention relates to a damper, and more particularly to a damper for a pivot door. The damper has a piston movably received inside the damper and having a first channel and a second channel respectively and selectively communicating with a space full of hydraulic oil, such that the movement of the piston is able to be slowed by the interchange of the communication of the first channel and the space and the second channel and the space.

2. Description of Related Art

Normally, a damper is mounted on a door, especially a glass door, to prevent the glass door from damage caused by a sudden movement. A conventional damper has a drive shaft securely inserted into a housing for connecting with the door and a cam mounted on the drive shaft. When the door is open/closed, the cam is driven by the drive shaft and a spring mounted around the drive shaft is compressed. The compressed spring is able to provide resistance to the door to prevent the door from a sudden movement, such that the glass door is protected.

However, the geometric shape of the damper has to be big and the configuration of the damper is complicated, such that the cost of the damper is high.

To overcome the shortcomings, the present invention tends to provide an improved damper to mitigate and obviate the aforementioned problems.

SUMMARY OF THE INVENTION

The primary objective of the invention is to provide an improved damper that has a space full of hydraulic oil, which functions to provide a resistance to a motion, and a piston movably received in the housing of the damper and provided with a first channel and a second channel. The first and second channel are individually and selectively in communication with the space for different phases of the movement of the piston, such that the movement of the piston is able to be slowed and the movement of the door is thus slowed.

Another objective of the invention is to provide a dust-free cap for the drive shaft. The dust-free cap has continuous serration formed on an inner face of the cap, such that when the cap is mounted onto the drive shaft, the continuous serration provides multiple barrels to prevent aliens from entering the inner structure of the damper.

With such an arrangement, the combination of the piston, a piston rod centrally connected to the piston and a T-shaped mount that is securely mounted on a guide board, the alignment of the movement of the piston inside the housing is enhanced and so as the smoothness of the movement of the piston. Furthermore, the life span of the damper is greatly increased.

Other objects, advantages and novel features of the invention will become more apparent from the following detailed description when taken in conjunction with the accompanying drawings.

DETAILED DESCRIPTION OF PREFERRED EMBODIMENT

Figure 1:
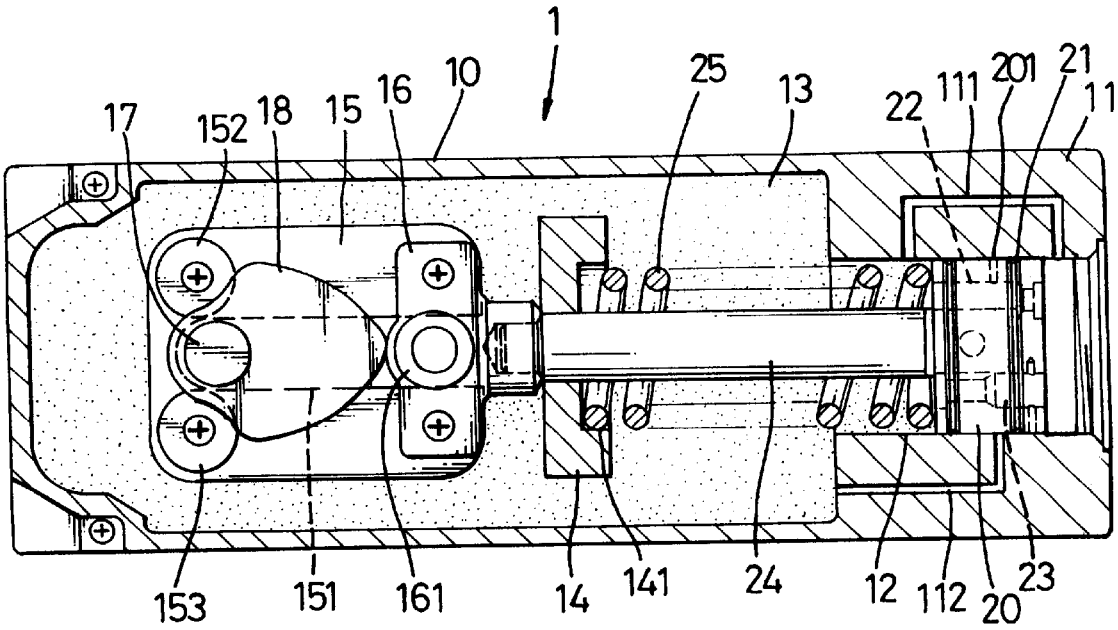
FIG. 1 is a partially sectioned view showing the inner structure of the damper in accordance with the present invention.

Referring to FIG. 1, the damper constructed in accordance with the present invention has a housing (10), a piston (20) and a space (13) full of hydraulic oil.

The housing (10) has an annular protrusion (11) defining therein a first channel (111) and a second channel (112), a path (12) defined through the protrusion (11), a positioning seat (14) integrally formed at a mediate position of the housing (10), a guide board (15) movably mounted inside the housing (10) and having a recess (151) and a pair of spaced first rollers (152,153) rotatably mounted on the guide board (15), a T shaped mount (16) securely mounted onto the guide board (15) and having a second roller (161) rotatably mounted onto the mount (16).

The housing (10) further has a cam (18) rotatably mounted onto the guide board (15) and engaging with the first rollers (152,153) and the second roller (161). A drive shaft (17) securely mounted onto the cam (18) and a free end of the drive shaft (17) is adapted to pivotally connect with the door.

Figure 2:
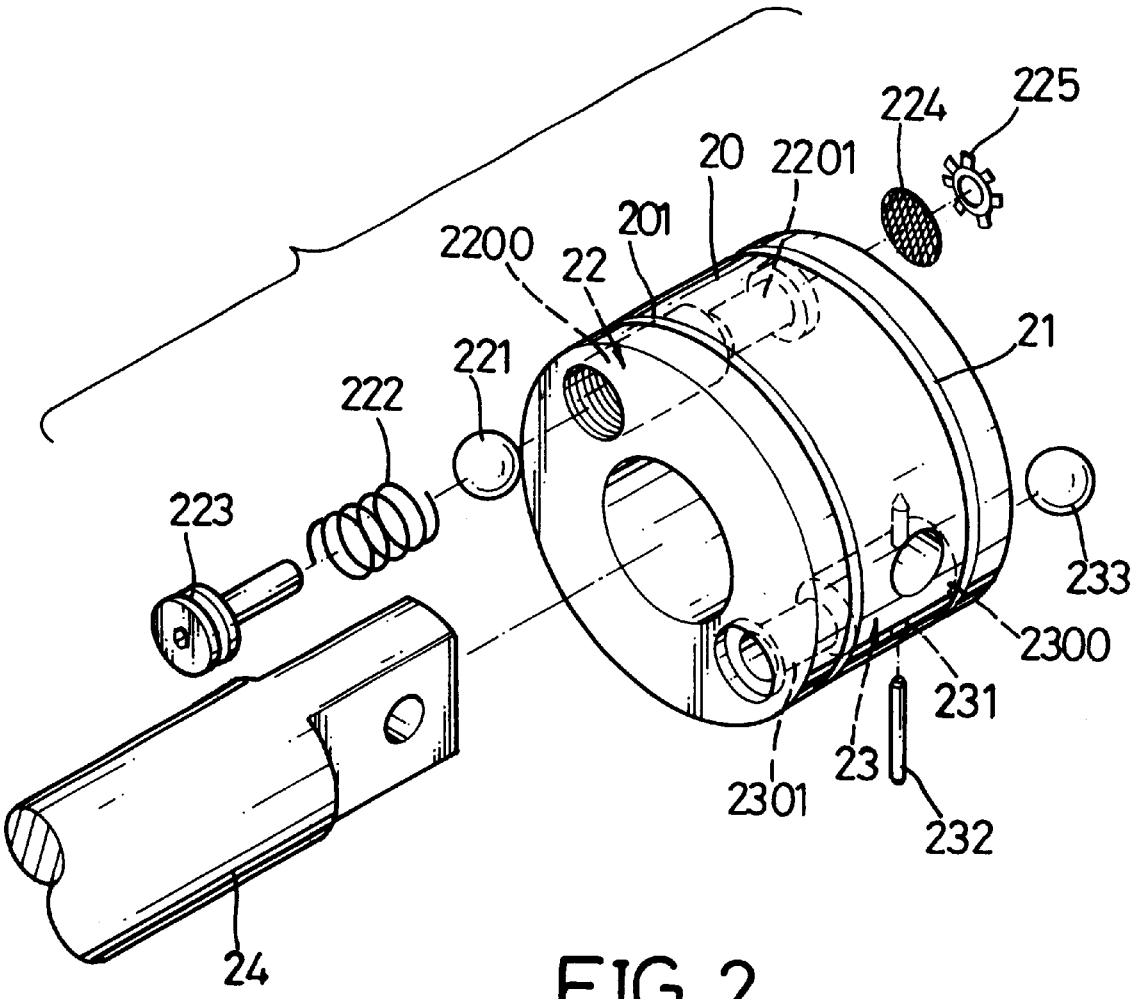
FIG. 2 is an exploded perspective view showing the structure of the piston mounted in the damper of FIG. 1.

With reference to FIG. 2, the piston (20) has a groove 21 annularly and peripherally defined in a periphery of the piston (20), a first chamber (22), a second chamber (23) and a piston rod (24) centrally and securely connected the piston (20) to the guide board (15). The first chamber (22) is divided into a large room (2200) and a small room (2201) communicating with the large room (2200) and having a diameter smaller than that of the large room (2200). The second chamber (23) is divided into a first room (2300) and a second room (2301) communicating with the first room (2300) and having a diameter smaller than that of the first room (2300). A grill (224) is received in the small room (2201) and is secured by a perforated stop (225). A first ball (221) and a spring (222) combination is received in the large room (2200) and is secured by a bolt (223). Because the diameter of the first ball (221) is larger than that of the small room (2201), such that the first ball (221) can only be movable inside the large room (2200). Furthermore, because the spring (222) abuts the first ball (221), the communication between the large room (2200) and the small room (2201) is normally closed. A second ball (233) is movably received in the first room (2300) and a lock pin (232) is inserted into a pin hole (231) to prevent the second ball (233) from slipping off the piston (20). Because the diameter of the second ball (233) is larger than that of the second room (2301), such that when the second ball (233) moves to the joint between the first room (2300) and the second room (2301), the communication between the first room (2300) and the second room (2301) closes. A recoil spring (25) is mounted around the piston rod (24) and one end of the recoil spring (25) abuts an underface of the piston (20) and the other end of the recoil spring (25) is received in a notch (141) in the positioning seat (14), such that when the piston (20) moves, the recoil spring (25) is reciprocally compressed and released.

Figure 3:
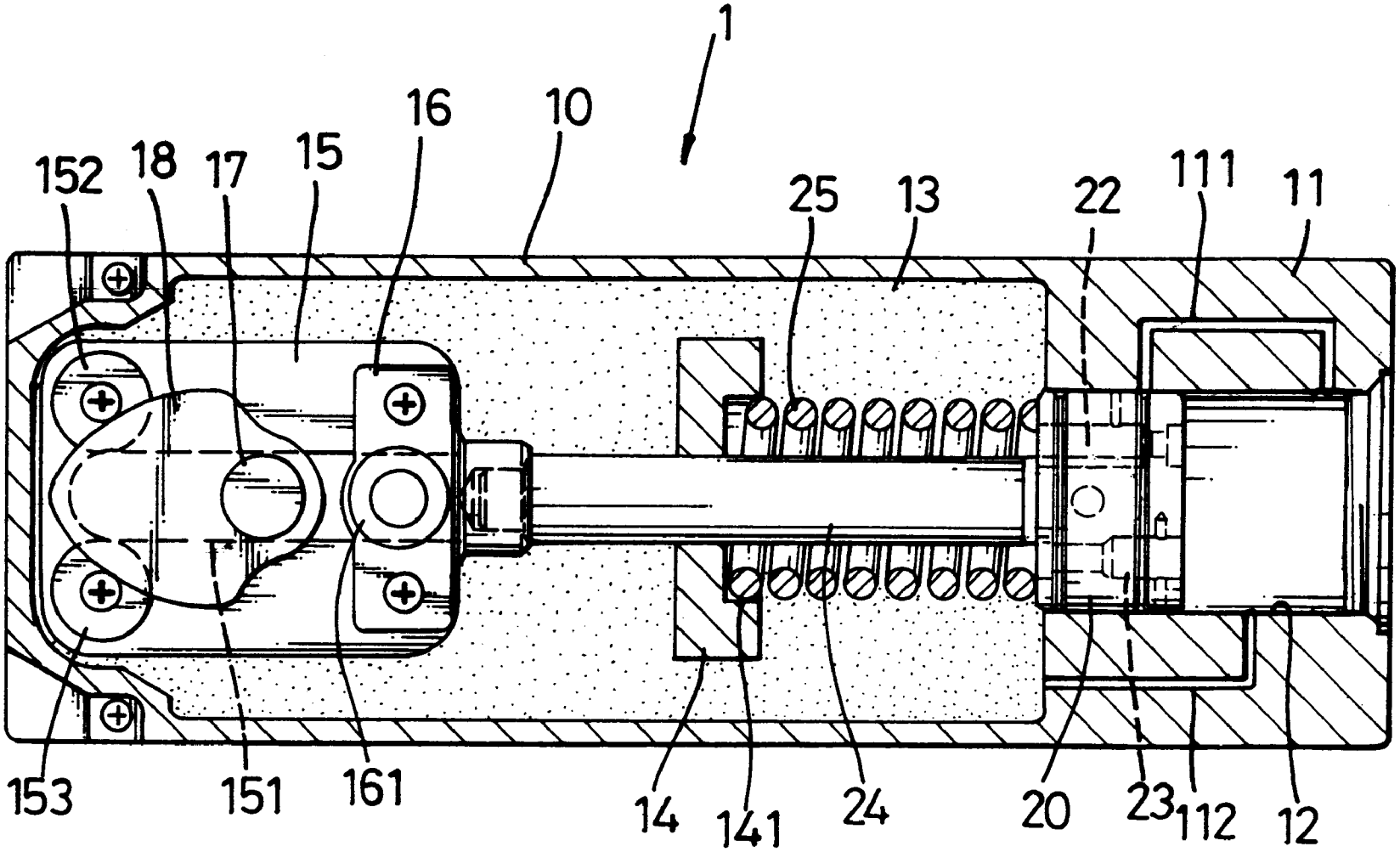
FIG. 3 is an operational view of the damper of the present invention.

When the damper is moved due to the movement of the door, the pivotal movement of the drive shaft (17) drives the cam (18) to pivot. Because the cam (18) is able to engage with the first rollers (152,153) and the second roller (161), the pivotal movement of the cam (18) pushes the guide board (15) to move, which also drives the piston rod (24) to move along with the guide board (15), as shown in FIGS. 1 and 3. When the piston (20) moves in a first direction, to the right as viewed from FIG. 1, the recoil spring (25) is releasing its recoil force stored in a previous motion. While the piston (20) is moving toward the distal end of the path (12), because the communication between the first channel (111) and the space (13) is blocked by the piston (20), the hydraulic oil inside the path (12) can only flow back into the space (13) from the second channel (112). Because the diameter of the path (12) is much larger than a diameter of the second channel (112) and when the hydraulic oil inside the path (12) is flowing to the space (13) by means of the second channel (112), the hydraulic oil inside the path (12) will push the second ball (233) backward to close the communication between the first room (2300) and the second room (2301). Because the hydraulic oil can only flow into the space (13) through the second channel (112), the hydraulic oil inside the path (12) becomes a damper to hinder the motion of the piston (20) which eventually slows down the movement of the drive shaft (17). When the hydraulic oil is flowing from the second channel (112) and the piston (20) is moving toward the distal end of the path (12), the piston (20) gradually closes the communication between the second channel (112) and the space (13) by closing the second channel (112) and gradually opens the communication between the path (12) and the space (13) by reopening the first channel (111), while the piston (20) moves. During the moving process, if the pressure in the hydraulic oil in the path (12) is too large, the pressure may force the first ball (221) in the first chamber (22) to retract in the large room (2200) so as to open the communication between the path (12) and the space (13). After the first ball (221) is moved away from the joint between the large room (2200) and the small room (2201), the hydraulic oil in the path (12) not only can flow through the second channel (112), but also flows through the first chamber (22). After the hydraulic oil in the path (12) flows through the first chamber (22), the pressure in the path is lessened. Meanwhile, because the second ball (233) is always located at the joint of the first room (2300) and the second room (2301) the hydraulic oil in the path (12) is not able to flow to the space (13) through the second chamber (23). When the piston (20) finally reaches the distal end of the path (12), all the hydraulic oil inside the path (12) flows back to the space (13) and the recoil spring (25) is in its released state, as shown in FIG. 1.

Figure 4:
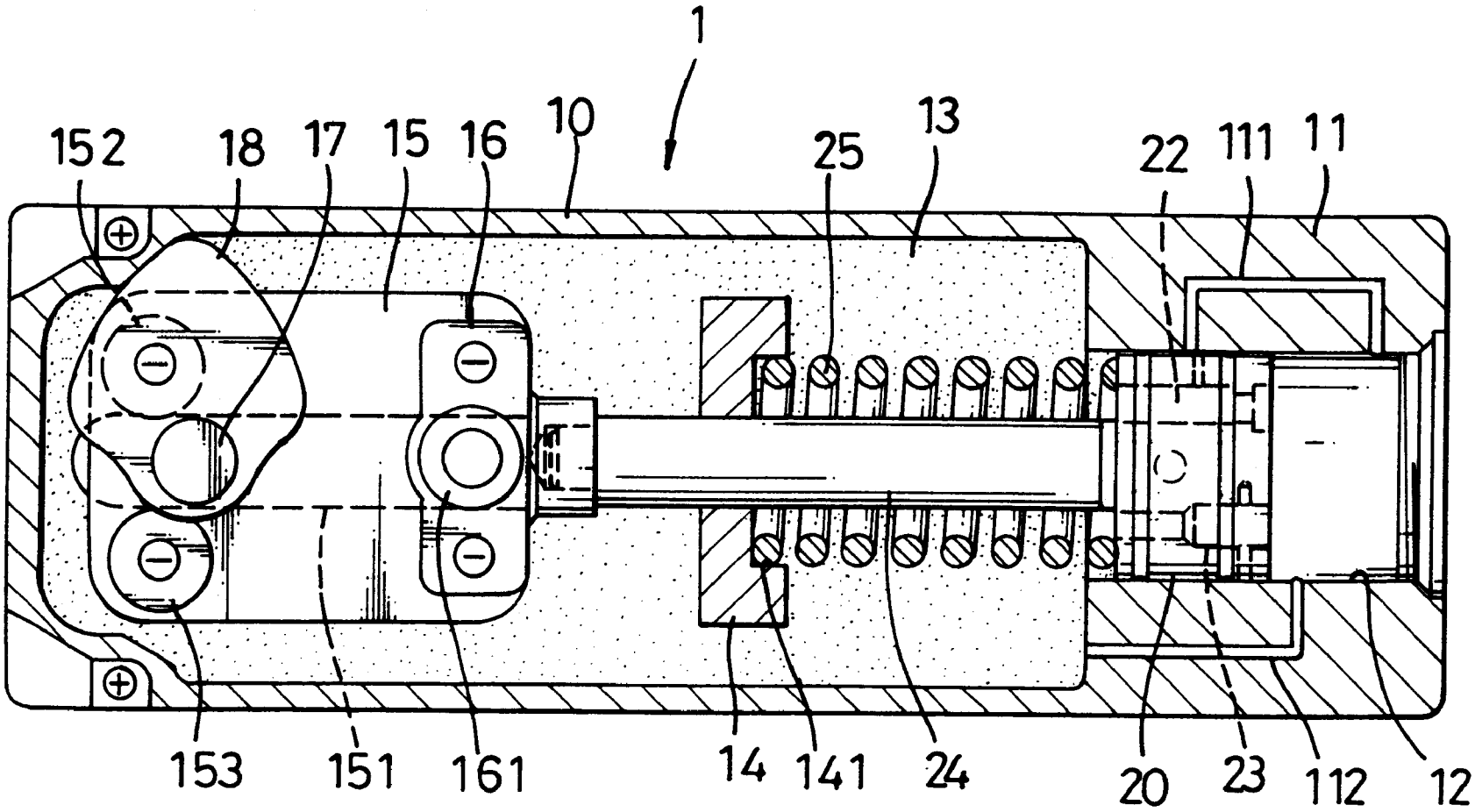
FIG. 4 is a partially sectioned view of the damper, wherein the drive shaft is moved to close the communication between the first channel and the hydraulic oil.

With reference to FIGS. 3 and 4, when the drive shaft (17) pivots, the pivotal movement of the cam (18) pushes the guide board (15) to move in a second direction, to the left as shown from the viewer to FIG. 3, the recoil spring (25) is compressed. While the recoil spring (25) is compressing between the piston (20) and the positioning seat (14), the hydraulic oil inside the space (13) is flowing to the path (12) from both the first channel (111) and the second channel (112) to fill a space defined by the movement of the piston (20) inside the path (12) to be ready for the next recoil movement of the piston (20) caused by the releasing of the recoil force of the recoil spring (25). That is, when the recoil spring (25) continues to be compressed and thus the piston (20) continues to move toward the space (13), the hydraulic oil in the space (13) continues to flow to the path (12) by way of the first and second chambers (22,23) as well as the second channel (112). Because the quantity of the hydraulic oil flowing from the space (13) to the path (12) is much larger than the quantity flowing from the path (12) to the space (13), the recoil spring (25) compressing stroke is much has less force than the recoil spring (25) releasing stroke. Thus, it is noted that when the user opens the door, due to the large flow of hydraulic oil to the path (12), only little force is required to open the door. However, when the door is closing, due to the little quantity of hydraulic oil flowing to the space (13) from the path (12), a damping effect is created to protect the door from damage.

Figure 5:
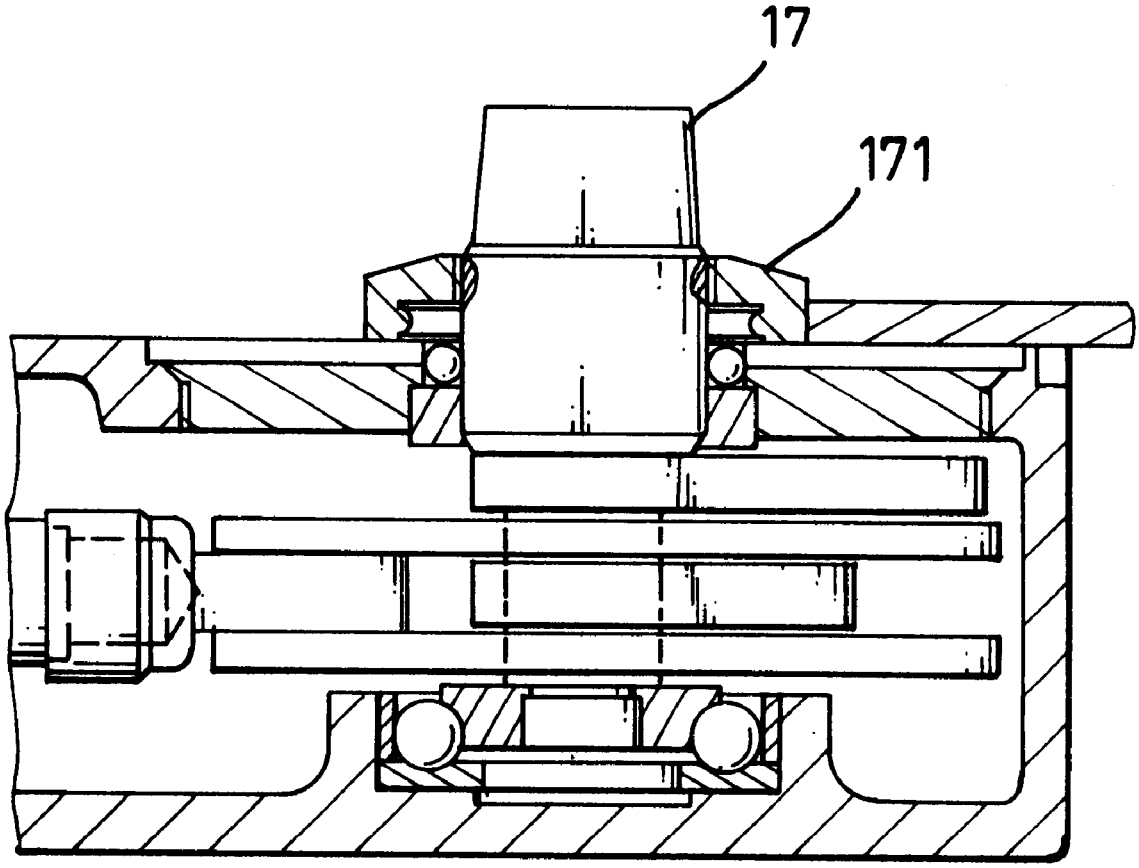
FIG. 5 is a sectioned view showing a dust-free cap of the invention that is used on the drive shaft to prevent contamination from pollutant.
Figure 6:
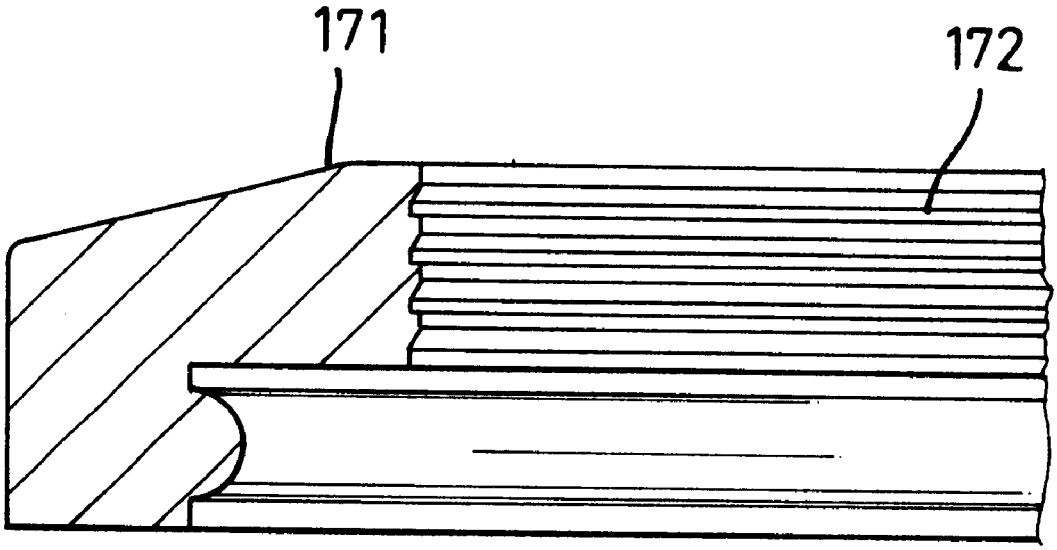
FIG. 6 is a sectioned view showing the inner structure of the dust-free cap that is used on the drive shaft.

Furthermore, with reference to FIGS. 5 and 6, the drive shaft (17) has a protective dust-free cap (171) with continuous serration (172) formed on an inner face of the cap (171), such that when the cap is mounted onto the drive shaft, the continuous serration provides multiple barrels to prevent aliens from entering the inner structure of the damper.

With such an arrangement as foregoing described, the damper of the invention has improved alignment of the piston inside the housing, better smoothness of the movement of the piston and longer life span of the entire damper.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A damper for a pivot door, the damper comprising:

a housing having a space full of hydraulic oil, an annular protrusion defining therein a first channel and a second channel, a path defined through the protrusion, a positioning seat integrally formed at a mediate position of the housing, a guide board movably mounted inside the housing and having a pair of spaced first rollers rotatably mounted on the guide board, a T shaped mount securely mounted onto the guide board and having a second roller rotatably mounted onto the mount; wherein the first and second channels selectively communicate with the space;

a cam rotatably mounted onto the guide board and engaging with the first rollers and the second roller;

a drive shaft securely mounted onto the cam and a free end of the drive shaft being adapted to pivotally connect with the door;

a piston having a first chamber, a second chamber in the piston, a groove annularly defined in a periphery of the piston and a piston rod securely connecting the piston to the guide board, wherein the first chamber is divided into a large room for movably receiving therein a spring and first ball combination and a small room selectively communicating with the large room for receiving therein a grill and a perforated lock and the small room has a diameter smaller than that of the large room, wherein the second chamber is divided into a first room for movably receiving therein a second ball and a second room selectively communicating with the first room and having a diameter smaller than that of the first room;

a recoil spring mounted around the piston rod and one end of the recoil spring abutted an underface of the piston and the other end of the recoil spring being received in a notch in the positioning seat, whereby when the piston moves, the recoil spring is reciprocally compressed and released and hydraulic oil flowing to the path from the space via the first and second chambers facilitates the movement of the piston, when the hydraulic oil flows to the space from the path by way of the second channel, a damping effect is created so as to function as a damper to protect the door.

2. The damper as claimed in claim 1, wherein the piston is movable in a first position and a second position, when the piston is at the first position, the recoil spring is in its released state and the communication of the first and the second channels with the space is blocked by the piston.

3. The damper as claimed in claim 2, wherein when the piston is at the second position, the recoil spring is in its compressed state.

4. The damper as claimed in claim 3, wherein the drive shaft further has a cap with continuous serration formed on an inner face of the cap, such that when the cap is mounted onto the drive shaft, the continuous serration provides multiple barrels to prevent aliens from entering the inner structure of the damper.

5. The damper as claimed in claim 2, wherein the drive shaft further has a cap with continuous serration formed on an inner face of the cap, such that when the cap is mounted onto the drive shaft, the continuous serration provides multiple barrels to prevent aliens from entering the inner structure of the damper.

6. The damper as claimed in claim 1, wherein the drive shaft further has a cap with continuous serration formed on an inner face of the cap, such that when the cap is mounted onto the drive shaft, the continuous serration provides multiple barrels to prevent aliens from entering the inner structure of the damper.

* * * * *